US008820553B2

(12) United States Patent
Endert

(10) Patent No.: US 8,820,553 B2
(45) Date of Patent: Sep. 2, 2014

(54) CLOSURE DEVICE FOR A CONTAINER

(75) Inventor: Guido Endert, Leichlingen (DE)

(73) Assignee: Cliqloc GmbH (DE)

( * ) Notice: Subject to any disclaimer, the term of this patent is extended or adjusted under 35 U.S.C. 154(b) by 565 days.

(21) Appl. No.: 12/994,863

(22) PCT Filed: May 27, 2009

(86) PCT No.: PCT/EP2009/056489

§ 371 (c)(1),
(2), (4) Date: Feb. 3, 2011

(87) PCT Pub. No.: WO2009/153154

PCT Pub. Date: Dec. 23, 2009

(65) Prior Publication Data

US 2011/0139787 A1 Jun. 16, 2011

(30) Foreign Application Priority Data

May 27, 2008 (DE) ..... 10 2008 025 429
May 27, 2008 (DE) ..... 10 2008 025 430

(51) Int. Cl.

| | |
|---|---|
| ***B65D 53/00*** | (2006.01) |
| ***B65D 50/04*** | (2006.01) |
| ***B65D 43/02*** | (2006.01) |
| ***B65D 51/16*** | (2006.01) |

(52) U.S. Cl.

CPC .... *B65D 43/0212* (2013.01); *B65D 2543/0037* (2013.01); *B65D 50/046* (2013.01); *B65D 2543/00935* (2013.01); *B65D 51/1683* (2013.01)

USPC ..... 215/272

(58) Field of Classification Search

USPC ..... 215/344, 260, 341, 354, 235, 236, 271, 215/272

See application file for complete search history.

(56) References Cited

U.S. PATENT DOCUMENTS

| | | | | |
|---|---|---|---|---|
| 2,979,219 | A * | 4/1961 | Barravecchia | 215/272 |
| 3,189,210 | A | 6/1965 | Heisler | |
| 4,016,996 | A | 4/1977 | Aichinger et al. | |
| 4,390,109 | A | 6/1983 | Schulein et al. | |
| 5,785,196 | A * | 7/1998 | Montgomery | 215/354 |

FOREIGN PATENT DOCUMENTS

| | | | |
|---|---|---|---|
| AU | 6950781 | A | 10/1982 |
| DE | 442634 | | 4/1928 |
| DE | 10312237 | A1 | 4/2004 |
| EP | 0508668 | A1 | 10/1992 |

(Continued)

OTHER PUBLICATIONS

International Search Report PCT/EP2009/056489; Dated Sep. 29, 2009.

(Continued)

*Primary Examiner* — Steven A. Reynolds
*Assistant Examiner* — King M Chu
(74) *Attorney, Agent, or Firm* — Cantor Colburn LLP

(57) ABSTRACT

A closure device for sealing an opening of a container, wherein the container opening has an opening edge which includes an inner wall and an outer wall. The closure device further includes a sealing element so that the opening of the container can be tightly sealed. A closure device of this kind is characterized in that a sealing of the container by the closure device is independent of a contact pressure applied from the closure device onto the container, in particular onto the opening edge.

13 Claims, 9 Drawing Sheets

(56) References Cited

FOREIGN PATENT DOCUMENTS

| | | | |
|---|---|---|---|
| EP | 1332978 | A2 | 8/2003 |
| FR | 2316141 | | 8/1975 |
| GB | 1433208 | | 10/1973 |
| JP | 6-69155 | U | 9/1994 |
| JP | 7-19148 | U | 4/1995 |
| JP | 8-230918 | A | 9/1996 |
| JP | 9-301413 | A | 11/1997 |
| WO | 8200126 | A1 | 1/1982 |
| WO | 2004056667 | A1 | 7/2004 |

OTHER PUBLICATIONS

Mexican Office Action issued Jun. 12, 2013 re: Mexican Application No. MA/a/2010/012881; citing: AU 6 950 781 A, US 4,016,996 A and US 4,390,109 A.

Mexican Office Action issued Jan. 28, 2014 re: PCT application No. MX/a/2010/012881; citing: US 2,979,219 and US 5,785,196.

Japanese Office Action issued Aug. 6, 2013; re: Japanese Patent Application No: 2011-511007; citing: JP H07 019148, JP H06 069155, JP H09 301413 and JP H08 230918.

* cited by examiner

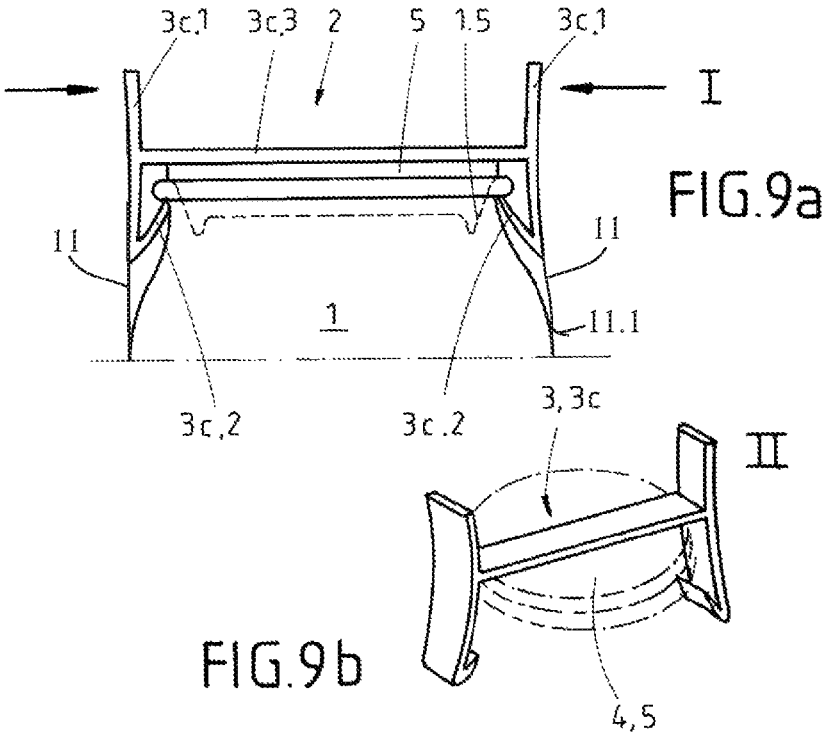
FIG.9a
FIG.9b
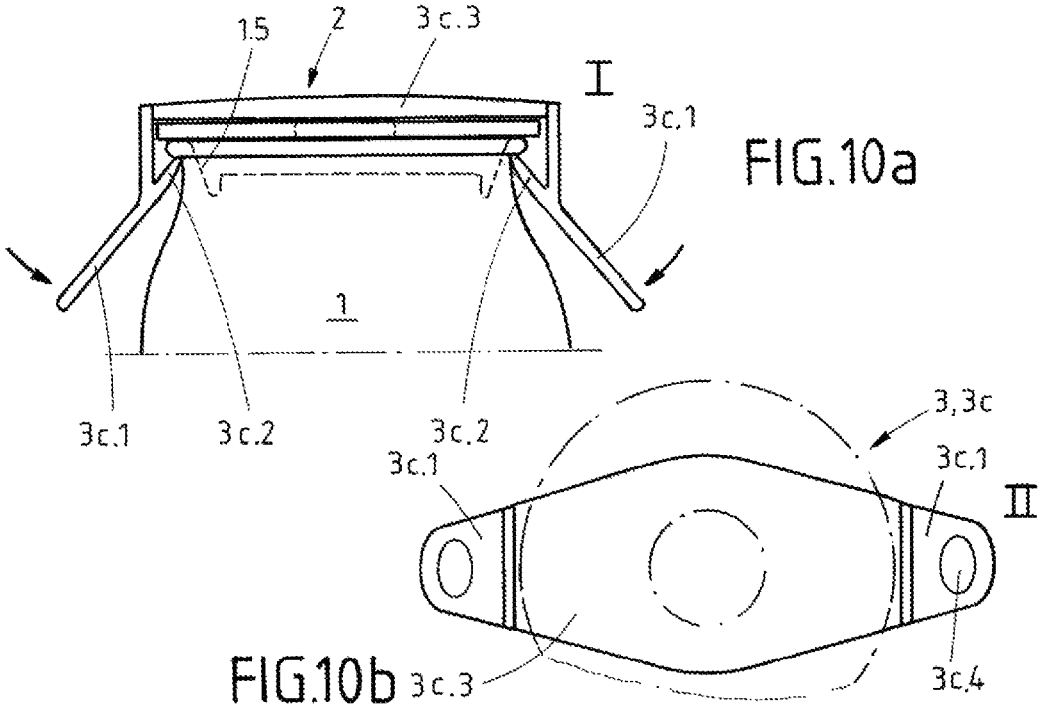
FIG.10a
FIG.10b

CLOSURE DEVICE FOR A CONTAINER

TECHNICAL FIELD

The following invention is directed towards a closure device for closing an opening of a container.

BACKGROUND

Such closure devices serve to close a container which has an opening edge comprising an inner and an outer wall. The container can, for example, comprise a can, in particular, a drinks can, bottle, storage container or similar. Furthermore, the container itself can comprise plastic, metal, porcelain, glass or various other materials. The closure device has a sealing element whereby the opening of the container can be closed in a sealing manner. Known containers are usually closed in a sealing manner by closure devices, by pressing the seal in the closure device between the closure device itself and the container, in particular an opening edge. By this means, a seal is effected particularly in containers which build up an internal pressure. In this context, it is known that the contact pressure on the sealing element must be greater than the internal pressure forming or present in the container so that the closure device correspondingly seals the container. Such closure devices are, for example in drinks bottles, integrated in the lid which serves as a closure device and pressed by means of the thread with the drinks bottle so that the sealing effect of the closure device is produced by a corresponding deformation of the seal. It is also known to close a test tube with a rubber stopper, the rubber stopper being configured in a frustro-conical manner and being pressed with a high contact pressure into the opening edge of the test tube in order to close this. In this case, a deformation of the rubber stopper must also be effected by a corresponding contact pressure. Furthermore, for example, crown cork closures for bottles are known which also press the sealing element between the crown cork closure, which serves as a closure device, and the bottle edge. Such crown cork closures have the disadvantage that they are not re-usable. Furthermore, they can only be attached with the aid of mechanical devices in order to close the bottle. In addition, further numerous variants of closure devices for containers are known from the general prior art, which all exert a corresponding contact pressure from above or inside onto the sealing element in order to deform this or press on the opening edge.

Known, for example, from the document DE 103 12 237 A1 is a closure for a can in which the can closure is attached mechanically in an opening of the can lid. The closure itself has a multipart structure and has a hinged lid which is integrated on the closure device. The entire can can then be sealed with the aid of the closure lid. This closure device has the disadvantage that on the one hand, it must be previously connected to the can by production technology and on the other hand, it does not close the can in a gas-tight or pressure-tight manner.

Further known from the prior art is the document WO 2004/056667 A1 which is directed towards a closure device for a drinks can. This closure device is firmly riveted on the upper side of the drinks can and can, for example, close the opening of the drinks can or, if the closure device is turned away, release it. For this purpose the closure device is turned about the rivet on the casing upper side. This closure device also has the disadvantage that the closure device does not seal the opening in a pressure-tight manner. In this case, there is always the risk that the internal pressure can escape through the closure device. If the drinks can is located in a tilted state, the contents flow out. Furthermore, this closure device is difficult to handle since the closure device is disposed inside the flanged can edge. In addition, the can must be held firmly with one hand and the closure device operated with the other hand.

BRIEF SUMMARY

The invention provides a closure device which enables easy and uncomplicated handling and reliably closes a container, in particular a container having an elevated internal pressure. At the same time, the closure device should be easy to use for weak and clumsy persons.

In the device according to the invention, it is provided that a sealing of the container by the closure device is independent of a contact pressure (Pk) which is applied from the closure device onto the container, in particular the opening edge. Consequently, the sealing element is not pressed between the closure device and the container, in particular the opening edge, in order to close the container in a sealing manner from above and/or from inside. Therefore no contact pressure needs to be applied by the closure device during sealing in order to close the container in a pressure-tight manner. A simple placement and arresting of the closure device, for example, by means of a form fit with the container, is sufficient for this. Consequently, a contact pressure (Pk) from the closure device onto the container produces no additional deformation of the sealing element in the sealing area. Hence the closure device according to the invention is particularly easy to actuate for weak and clumsy or movement-impaired persons. Unlike in the conventional closure devices, no contact pressure (Pk) needs to be exerted on the closure device so that the container is nevertheless reliably sealed. On the contrary, the pressure on the sealing element produced by the own weight of sealing element and possibly closure device is sufficient to possibly slightly deform this, whereby the sealing element is exactly geometrically adapted or moulded to the container in order to tightly seal the container. Consequently, the closure device according to the invention is configured to be self-sealing since the existing or still-forming internal pressure (Pi) is used to seal the container. In so doing, the internal pressure (Pi) presses the sealing element onto the opening edge, in particular onto the inner wall of the opening edge, whereby it additionally deforms the sealing element (the existing internal pressure Pi is meant) and presses it more strongly onto the container.

Preferred embodiments of the invention are presented in the dependent claims.

In this case, it is provided, for example, that the sealing element itself has a sealing lip which projects into the opening of the container and comes to abut sealingly against the inner wall of the opening edge due to an elastic deformation. In so doing, the sealing lip abuts loosely on the inner wall of the opening edge without being pressed into the inner wall by another element such as, for example, the closure device. For this purpose, the sealing lip has, for example, a wedge-shaped or trapezoidal cross-section which abuts flexibly or highly flexibly against the inner wall of the opening edge and is readily deformable. For example, PTFE, silicone, rubber or PU foam etc. can be used as material for the sealing element, in particular the sealing lip, at the same time the selected material should be flexible to highly flexible. This material is readily deformable so that the sealing lip can abut unconstrainedly and without any expenditure of force (therefore force-free) against the inner wall of the opening edge and adapt over the full circumference. In so doing, a closed sealing line should initially form between the sealing lip and the opening edge or the inner wall. Due to the abutment points of the sealing lip on the opening edge or on the inner wall, the container is completely sealed. This material, for example, has a hardness of 10 to 90 shore A, in particular of 40 to 90 shore A (according to the standards DIN 53505 and DIN 7868). A material having a hardness of 70 shore A is preferred since the best sealing results so far have been established in this case. At the same time, the material is indeed flexible but also dimensionally stable, which means that the seal retains its basic shape even after a deformation in order to thus obtain the desired sealing effect. For this purpose, the sealing element can have a dimensionally stable core made of harder material which is surrounded by a softer or more flexible material. It is also feasible to obtain the dimensional stability by constructive measures such as, for example, reinforcing ribs, edges or the like. It has also proved to be advantageous if the abutting surface of the sealing lip is configured to be smooth in the area of the sealing line.

The self-acting sealing of the container by the closure device is made by the shape and size and the material properties of the sealing element, in particular by the sealing lip. At the same time, it is provided that an outer contour of the sealing element, in particular of the sealing lip, is configured to be complementary to an inner contour of the opening edge of the container, wherein the sealing element, in particular the sealing lip, abuts against the inner wall of the opening edge over the full circumference. If, for example, the inner contour of the opening of the container is configured to be circular, the outer contour of the sealing element is therefore also substantially circular. In the case of a triangular opening contour, the outer contour of the sealing element is also configured to be substantially triangular. Likewise, the size of the sealing element substantially corresponds to the size of the container opening to be closed. In this case, it can optionally be provided that an external circumference of the sealing element is somewhat larger, i.e. a few tenths of a millimeter to millimeters, than the maximum size of the internal circumference of the opening edge. Due to this configuration of the sealing element, in particular the sealing lip, the desired elastic deformation is achieved, which is necessary for the initial sealing of the container so that the sealing element can cooperate with the opening edge. For this elastic deformation, no contact pressure is required between the closure device and the container. On the contrary, the pure weight of the sealing element or the closure device is sufficient to effect the desired elastic deformation of the sealing element and therefore the secure or sealing abutment and/or moulding of the seal to the container. At the same time, the dimensional stability of the sealing element itself is helpful for bringing the sealing lip to abut securely against the opening edge or the inner wall. Otherwise, if the elastic deformations are too great, the sealing element could tend to form wrinkles or kinks which are undesirable since this would prevent a sealing.

As has already been mentioned, the contact pressure (Pk) which is applied from the closure device onto the container, in particular the opening edge, is substantially unimportant for the operating mode of the sealing element so that it is without effect in the sense of this application. If a contact pressure (Pk) between the container and the closure device is too high, the sealing element can even be deformed, e.g. by wrinkle formation in such a manner that a sealing no longer takes place. Consequently, the operating mode of the closure device according to the invention does not depend on the contact pressure (Pk) between the container and the closure device. Also, after merely placing the closure device on the opening of the container, whereby a slight initial deformation or adaptation to the container takes place (without further fastening or arresting of the closure device with the container due to the aforementioned form fit), the sealing element need not be additionally elastically deformed in order to correctly seal the container, which means against a high internal pressure (Pi). On the contrary, due to the closure device according to the invention, the container can be sealed self-actingly in a pressure-tight and/or fluid-tight manner by means of the sealing element without producing a previous contact pressure (Pk) between the container and the closure device from above and/or from inside. It is thus possible, for example, to even seal conventional drinks cans or drinks bottles which build up a high internal pressure (Pi) due to their carbonic acid content in a gas and fluid-tight manner. Also no constructive modification of the containers known from the prior art is required to use the closure device according to the invention.

It can further be provided that the sealing lip of the sealing element is initially only pressed onto the inner wall by its (slight) elastic deformation, wherein in particular a developing or existing internal pressure of the container additionally deforms the sealing lip and/or presses the sealing lip onto the inner wall if the internal pressure (Pi) is greater than an external pressure (Pa) surrounding the container from outside. Thus, the existing and possibly increasing internal pressure (Pi) also automatically increases the sealing effect of the sealing element and therefore of the closure device since this is pressed more strongly and possibly more extensively onto the container. Unlike in usual seals, it is therefore not necessary to press the closure device more firmly onto the container so that the closure device still reliably closes the container with increasing internal pressure (Pi). On the contrary, the existing internal pressure (Pi) in cooperation with the sealing element fulfils this task. In the closure device according to the invention, only a destruction or tearing of the sealing element, in particular of the sealing lip itself, leads to a leakage of the closed container.

It is also feasible that the sealing element simultaneously acts as a valve element so that the internal pressure (Pi) of the container is automatically adapted to the external pressure (Pa) of the container if the external pressure (Pa) is greater than the internal pressure (Pi). It is therefore possible that a fluid, usually in the form of air, can penetrate into the container from outside but not conversely. In this case, the higher external pressure (Pa) presses the sealing lip away from the inner wall of the opening edge when the internal pressure (Pi) of the container is lower. However, if the internal pressure (Pi) of the container is higher than the external pressure (Pa), the internal pressure (Pi) presses the sealing lip onto the inner wall of the opening edge with the result that the pressure is maintained in the container. For this it is necessary that the sealing lip is correspondingly flexibly configured in order to thus adapt to the pressure differences due to its elastic deformation. This adaptation of the sealing element also functions in the case of a hydrostatic internal pressure on the seal, e.g. due to sloshing liquids in the container.

Likewise, in one embodiment of the invention it can be provided that the sealing element extensively seals the entire opening of the container with a flat part, wherein the sealing element has an angled edge zone from the flat part which is substantially formed by the sealing lip. Thus, the entire opening of the container can be sealed merely by the sealing element. In another embodiment of the invention it is feasible that the closure device has a retaining plate to which the sealing element is fastened, wherein in particular the sealing element is only configured as a sealing lip and the sealing lip is arranged in a pressure-tight and/or fluid-tight manner on the retaining plate. Consequently, the extensive part of the sealing element can be dispensed with since this is replaced by the additional retaining plate. It is also feasible that the additional retaining plate completely fixes the sealing element on its rear side. For this purpose, the sealing element can be welded, adhesively bonded or injection moulded to the retaining plate. It is also feasible that the sealing element is connected to the retaining plate by means of a form fit and/or frictional connection. In this case, however, the sealing element should seal the entire opening of the container with the flat part in order not to produce any additional tightness problems at the intermediate points between sealing element and retaining plate.

The closure device itself is fastened on the container by a closure element, wherein the closure element in particular cooperates positively with the container by means of a closure, in particular a threaded closure, a bayonet closure, a click-clack closure, a clasp closure, a clip closure, a loop closure and/or a sliding closure. The closure element thus ensures that the sealing element withstands the internal pressure of the container since otherwise the sealing element with the closure device would be pushed out from the opening of the container. For this purpose, the already-mentioned retaining plate can be disposed between the closure element and the sealing element. The previously mentioned closure between the closure element and the container can only exist on a form fit. In addition, a frictional connection can optionally ensure the positionally fixed fixing of the closure device above the opening of the container. However, this frictional connection does not result in any elastic deformation of the sealing element at the regions to be sealed, in particular the sealing lip.

In order to improve the operation of the closure device, this can be fitted with a safety element and/or a valve, wherein the safety element avoids or makes difficult any unintentional opening of the container and the valve is configured as a pressure relief valve or a drain valve. This safety element is intended to prevent the closure device from being unintentionally removed from the container. In this case, the safety element should be matched to the closure provided. The previously mentioned valve is intended to prevent an explosion-like, in particular uncontrolled, opening of the closure device from a container at high internal pressure by allowing the excess pressure to escape beforehand. In order to enable particularly easy operation of the closure device, it is feasible that operation of the closure element leads directly to or has already previously led to operation of the valve. Consequently, the valve is necessarily actuated first, whereby the possibly existing internal pressure (Pi) can escape in order to open the closure device. Such a valve can be provided with a desired acoustic function which can be produced by a blow-in or cutting edge. In this way, the area of application of the closure device, particularly for visually impaired persons and/or for advertising purposes or the like, can be significantly increased.

It is also feasible to provide the closure device with a tamper-evident closure whereby it can be shown that the container, hitherto unused, was closed by the closure device according to the invention. Such a tamper-evident closure can be a paper and/or film seal which, for example, can easily be removed by means of a pull-off tab. The tamper-evident closure can also have predefined predetermined breaking points which break when the closure device is actuated for the first time to open the container.

In already-mentioned click-clack closure (colloquial designation for this type of closure), the closure element of the closure device has a centre piece having holding means disposed in approximately the central actuation zone and on the centre piece. In relation to a first position (I) in which the closure element forms a form fit with the container, in particular with a projection or a groove on the container outer edge, the centre piece has an inner surface pointing towards the container and an outer surface pointing away from the container. The holding means which marginally surround the centre piece in particular in the manner of a crenellation, are bent at an angle $\alpha$ towards the inner surface. In this case, the angle $\alpha$ is preferably somewhat greater than 90°. Each holding means is also bent at its end again towards the inner surface, ideally bent at right angles towards the longitudinal axis of the container or even directed slightly upwards in order to achieve a secure form fit between closure element and container.

The closure element is preferably made of hard metal, in particular of metal or plastic but is nevertheless sufficiently elastic that it can adopt two different positions (I, II) in the form of two secured positions. In the first position (I), the closure device closes the container with the closure element. The centre piece hereby covers the opening of the container. In this case, it is slightly curved away from the container in the direction of the longitudinal axis. When viewed from the inner surface of the centre piece, this corresponds to a concave curvature. Due to this curvature the holding means run approximately parallel to the side surface of the container which has the projection. In this case, the angled ends of the holding means form a form fit with the projection. Therefore, unlike other containers, the container also remains closed when an attempt is made to open the container by pulling apart closure element and container.

The container can be opened, on the other hand, if a pressure is applied only to the actuation zone in the direction of the longitudinal axis and towards the container. The centre piece undergoes an elastic deformation from one secured position into the other and curves in the direction of the container. When viewed from the inner surface of the centre piece, this corresponds to a convex curvature. In the course of the elastic deformation, the holding means move away from the container and release the projection. By this means the closure device with the closure element can now be released from the container, easily and without any force, in particular without applying any tensile force.

If the container is to be closed again, the closure device with the closure element is placed with the inner side to which the holding means point, on the container. In this case, the holding means are still at a slight distance from the projection. By means of pressure on the holding means, in particular perpendicular to the longitudinal axis, the centre piece moves from one secured position, corresponding to convex curvature when viewed from inside, into the other secured position, corresponding to concave curvature when viewed from inside, and the closure element enters into its first position (I) again.

In the closure device according to the invention, it can be provided that the sealing element is disposed or fastened in the closure element by means of a form fit, a welded connection and/or a heat embossing. In a click-clack closure the available holding means can be used for the positive fastening. An edge of the sealing element protruding over the sealing lip can also serve as a stop buffer or means for the opening edge of the container. Expediently the sealing element does not project from the closure device so that an unintentional destruction of the sealing element in the event of the closure device not being used can be reliably avoided. Consequently, the closure device can be temporarily placed, no matter how, on a table or the like, without the seal being able to come in contact with the table.

The invention further provides a container which can be reliably closed with a closure device by a simple manipulation without any fluid being able to escape from the closed container. This container can, for example, comprise a conventional can, drinks can, storage can, bottle or the like which can be composed of most diverse materials.

The present invention also provides a method for sealing a container with an opening by means of a closure device which is easy to handle and seals the opening of the container by the closure device. In this context, it is provided according to the invention that a sealing of the container by the closure device takes place independently of a contact pressure (Pk) which is applied from the closure device onto the container, in particular the opening edge. The method according to the invention can be executed with the closure device according to the invention. Features and details described in connection with the closure device according to the invention naturally also apply in connection with the method according to the invention and conversely. Features mentioned in the claims and in the description can each be essential to the invention by themselves or in combination.

BRIEF DESCRIPTION OF THE DRAWINGS

Preferred exemplary embodiments of the invention are given in the following description with reference to the appended drawings and the following description. The exemplary embodiments are examples and are not shown true to scale. In the figures:

FIG. 9*a* shows a side view of a bracket-like closure device on a container, FIG. 9*b* shows a three-dimensional view of the closure element from FIG. 9*a* but without retaining plate and sealing element, FIG. 10*a* shows a side view of a closure device which is also configured to be bracket-like on a container, wherein the actuating brackets are directed downwards, FIG. 10*b* shows a plan view of the closure element from FIG. 10*a*.

DETAILED DESCRIPTION

In the following figures, the same technical features are provided with identical reference numbers, even when these are presented in a different embodiment of the invention.

Figure 1:
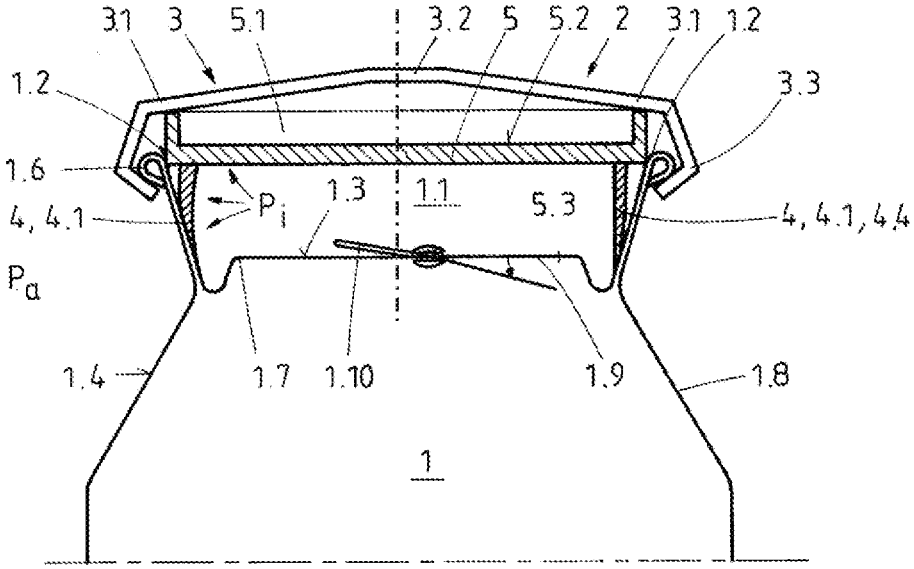
FIG. 1 shows a cross-section through a closure device according to the invention which closes the opening of a container, wherein the closure element comprises a click-clack closure.

FIG. 1 shows a first variant of the closure device 2 according to the invention, where this closure device 2 in a first position I closes an opening 1.1 of the container 1. In the present variant, the closure device 2 shown comprises a closure element 3 which is configured to be substantially plate-shaped. In this case, the closure element 3 has a substantially flat centre piece 3.1 which is centred around an actuation zone 3.2. Furthermore, angled holding means 3.3 are disposed on the centre piece 3.1, which serve to positively fasten the closure device 2 on the container 1.

In FIG. 1 the closure element 3 forms the click-clack closure already described, which is characterised in that in a first position I it positively and/or partially non-positively closes the container 1 and releases it in a second position II. The principle is based on a convex metal disk which is substantially formed from the centre piece 3.1 and the actuation zone 3.2, which can have two low-stressed states. By means of a perpendicular pressure towards the container 1 (in the direction of the longitudinal axis 2.1), e.g., by means of a finger on the actuation zone 3.2 or by a radial pressure (perpendicular to the longitudinal axis 2.1) on the holding means 3.3, it changes to and fro between two states, with the result that the first and the second position I, II are obtained. For this closure element 3 there is no unstressed state but depending on the method of manufacture, one final state can be less stressed than the other. In FIGS. 1 and 2*b* the closure element 3 is only shown in the first position I. As a result of a perpendicular pressure on the actuation zone 3.2, the closure element 3 thus changes into its second position II. In so doing, the holding means 3.3 which grip a projection 1.6 or the edge of a groove of the container 1 in position I, are folded away, so that the entire closure device 2 can be removed from the container 1, in particular from the opening 1.1, without further efforts.

The closure device 2 further has a retaining plate 5 which is disposed on the underside of the closure element 3. In the present example, the retaining plate 5 is firmly connected to the closure element 3, in particular at the outer edge zone of the centre piece 3.1. In order that the closure element 3 can adopt the two previously described states, an extensive recess 5.1 is provided on the upper side 5.2 of the retaining plate 5. Consequently, a circular web projects at the edge on the upper side 5.2 of the retaining plate 5, this web being used to fasten the retaining plate 5 to the closure element 3. The closure element 3 can dip with its centre piece 3.1 into the recess 5.1 of the retaining plate 5 when it adopts its second position II following a pressure on the actuation zone 3.2. Furthermore, the retaining plate 5 can serve to form a stop for the closure device 2 on the container 1. For this purpose the edge zone of the underside 5.3 can cooperate with an inner wall 1.3 of the opening edge 1.2 of the container 1. It is hereby possible that the closure device 2 can only be guided as far as the stop of the retaining plate 5 onto the inner wall 1.3 of the opening 1.1 of the container 1.

Furthermore, the sealing element 4 is located on the underside 5.3 of the retaining plate 5, which sealing element substantially only contains the sealing lip 4.1. This sealing lip 4.1 is configured annularly, the ring itself having a wedge-shaped cross-section. The sealing element 4 is itself configured flexibly to highly flexibly and as a result of its elastic deformation, fits the contour of the inner wall 1.3 without any expenditure of force merely due to the weight of the sealing element 4 or the closure device 2.

In FIG. 1 the right section through the sealing lip 4.1 is shown in such a manner that it comes to abut against the inner wall 1.3 of the opening 1.1 when the closure device 2 is placed on the container 1. Even the form fit between the closure element 3 and the container 1 cannot alter this alignment of the sealing lip 4.1 since the entire closure device 2 specifically does not need to exert a contact pressure Pk onto the sealing element 4 in order to nevertheless effect a pressure- and fluid-tight sealing of the container 1 by the closure device 2. On the contrary, the pressure plate 5 can be used as stop means so that a too-high contact pressure Pk does not act on the sealing element 4, in particular the sealing lip 4.1, whereby the desired abutment of the sealing element on the inner wall 1.3 is negatively influenced. If the contact pressure Pk is too high, a deformation of the sealing element 4 can take place in such a manner that no fully circumferential abutment of the sealing element on the inner wall 1.2 is provided and consequently the desired continuous sealing line exists between sealing element 4 and inner wall 1.3 or the opening edge 1.2 as shown in the right section through the (circular) sealing lip 4.1. For understanding, in the same FIG. 1 in the left section of the same sealing lip 4.1, it is shown how an elevated internal pressure Pi acts on the sealing element 4. In this case, it can be seen that the internal pressure Pi ensures that the sealing element 4, in particular the sealing lip 4.4 abuts against the inner wall 1.3 of the opening 1.1 in an arcuate manner. By this means the sealing surface between inner wall 1.3 and the sealing lip 4.1 is enlarged, thus also improving the sealing effect. An even higher internal pressure Pi ensures that the sealing element is pressed even more extensively onto the inner wall 1.3 of the opening edge 1.2. It should be mentioned for clarification that in FIG. 1 two different pressure states are shown in the left and right region of the sealing lip 4.1, which naturally do not occur in such a manner in practice.

Figure 2A:
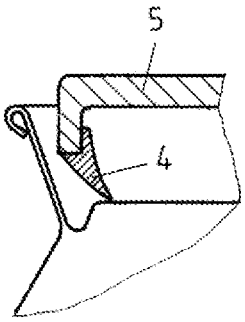
FIG. 2*a* shows a schematic cross-section through a closure device according to the invention without closure element which has a structure similar to FIG. 1 in which the sealing lip abuts on a region in an arcuate manner.
Figure 2B:
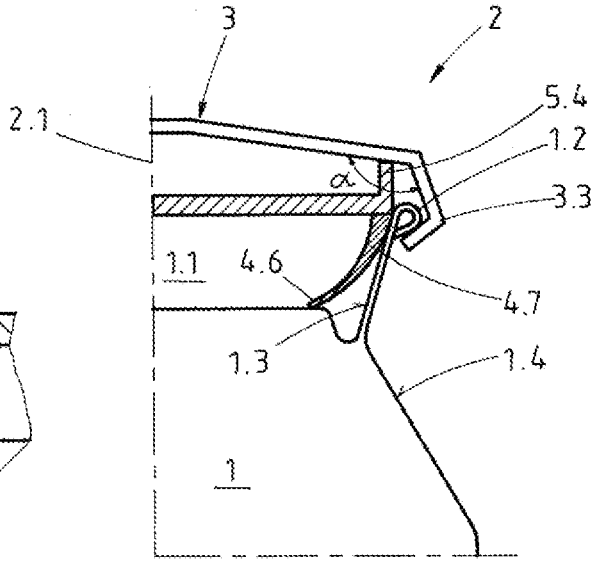
FIG. 2*b* shows a further cross-section through the closure device according to the invention, which has a structure similar to FIG. 1, in which the sealing lip abuts in an arcuate manner.

The container shown in FIGS. 1 and 2*a, b* is formed by a conventional drinks can. This can has a can lid, formed by the first metal sheet 1.7, separate from a cylindrical can shell which tapers towards the top. The can shell forms the second metal sheet 1.8. The two metal sheets are outwardly flanged at the edges to reliably close the container 1. In this case, the flanging forms the opening edge 1.2 with the projection 1.6. In the present example, the sealing lip 4.1 abuts against the double-walled inner wall 1.3 of the opening 1.1. The double-walled configuration of the can is obtained from the superposed metal sheets 1.7 and 1.8 at this point.

If the container 1, which is shown in FIGS. 1 and 2*a, b* in the form of a drinks can, is now opened by a normal passage 1.9 which is provided for drinking and pouring from the container 1, the container 1 can no longer easily be closed. The passage 1.9 is disposed in the first metal sheet 1.7, the first metal sheet 1.7 itself forming an intermediate sheet in the opening 1.1. Usually the passage 1.9 in a drinks can is opened by a tab 1.10 which is riveted on the first metal sheet 1.7. By raising the tab 1.10 at the long end, directly comparable to a lever, the tab 1.10 is pushed with the short end, located on the opposite rivet side, into the first metal sheet 1.7 which has a pre-stamped contour for the passage 1.9, whereupon the pre-stamped region in the metal sheet 1.7 yields and the passage 1.9 is formed. The pre-stamped region of the metal sheet 1.7 now projects into the drinks can (see FIG. 1) with the result that this is now opened.

If the closure device 2 according to the invention is now placed on the opening 1.1 and arrested positively with the container 1 by the closure element 3, the container 1 can subsequently be easily closed securely and in a fluid- and pressure-tight manner. Only the closure device 2 according to the invention is required for this, which device can be purchased separately from the container 1 and used. For example, this closure device 2 can be attached to a six-pack of drinks cans. The closure device 2 can also be distributed as advertising means additionally to the drinks cans.

If the closure device 2 according to the invention is now placed on the container 1 in the first position I, the sealing element 4, in particular the sealing lip 4.1, abuts against the inner wall 1.3 which is accomplished by the elastic deformation of the sealing element 4. For this purpose, the sealing element 4 comprises rubber, silicone or PTFE or another flexible or highly flexible material. It is only important that the sealing element 4 can easily be deformed elastically, the entire sealing element 4 overall having a certain dimensional stability.

If the internal pressure of the container 1 is now increased in the first position I, for example, due to carbonic acid containing drinks, the internal pressure Pi has the effect that the sealing lip 4.1 is pressed more strongly against the inner wall 1.3 (see arrow Pi in FIG. 1). Consequently, the sealing effect of the present sealing element 4 is intensified by an increasing internal pressure Pi. Even in the case of drinks not containing carbonic acid, such as orange juice, or oil, merely the liquid pressure produced by a tilting of the container into the side position and acting on the sealing element 4, has the effect that the sealing lip 4.1 is pressed more strongly onto the inner wall 1.3. Consequently, the sealing effect of the sealing element 4 is hereby also intensified. If the container 1 without carbonic acid-containing drinks, which has been closed with the closure device 2 according to the invention, is now placed in the refrigerator, the internal pressure Pi of the container is reduced, whereupon the higher external pressure Pa presses the sealing lip 4.1 away from the inner wall 1.3 and thus ensures pressure equalization between internal pressure Pi and external pressure Pa. This pressure equalization takes place until the internal pressure Pi lies above the external pressure Pa at some point. In this case, the sealing element 4 then acts as a valve element, whereby the elevated internal pressure Pi cannot escape from the container 1.

FIG. 2*b* show an exemplary embodiment of the closure device 2 comparable to FIG. 1. Here the sealing element 4 does not abut extensively against the inner wall 1.3 but only touches it in two regions. In the first region 4.6 the sealing element abuts against the horizontally configured inner wall 1.3 with its lower end of the sealing lip 4.1. And in the second region 4.7, the sealing lip 4.1 abuts with the upper end, which is located on the retaining plate 5, against the almost perpendicular inner wall 1.3. If the internal pressure Pi increases with this abutment of the sealing element 4 in the opening 1.1, the sealing lip 4.1 undergoes further elastic deformation with the result that the sealing lip 4.1 is in turn pressed more onto the inner wall 1.3 in both regions 4.6, 4.7. If the internal pressure Pi increases to such an extent that the first region 4.6 slips from the horizontal inner wall 1.3, in the present case the sealing lip 4.1 comes to rest extensively on the inner wall 1.3. In this case, an elevated internal pressure Pi also does not lead to any pressure loss in the container 1.

It should fundamentally be noted that in the closure device 2 according to the invention with the specially configured sealing element 4, a pressure loss can only take place due to a destruction of the sealing element 4.

FIG. 2*a* shows a closure device 2 similar to FIG. 2*b* but without the closure element 3. In this case, the retaining plate 5 with the sealing element 4 arranged thereon is placed loosely in the opening 1.1 of the container 1, whereupon an elastic deformation of the sealing element 4 is produced due to the weight of the retaining plate 5 itself with the sealing element 4. In this case, the acute-angled sealing lip 4.1 of the sealing element 4 abuts in a punctiform manner (in relation to the section) with the free end on the inner wall 1.3, resulting in the desired sealing. The retaining plate 5 itself has an angled edge zone which is configured to be substantially rectangular and at the end of which the sealing element 4 is disposed in a pressure- and fluid-tight manner. This sealing element can, for example, be injection-moulded on, welded-on, lasered-on or glued on. In the exemplary embodiment from FIG. 2*a*, an elevated internal pressure Pi also has the effect that the sealing lip 4.1 abuts extensively against the inner wall 1.3 of the opening 1.1. Consequently, a continuous sealing surface is obtained from the initial, continuous fully circumferential sealing line between sealing element 4 and container 1. In the event of an increase in the internal pressure Pi, in FIG. 2*a* the retaining plate 5 does not act as stop means for the entire closure device 2.

Figure 3A:
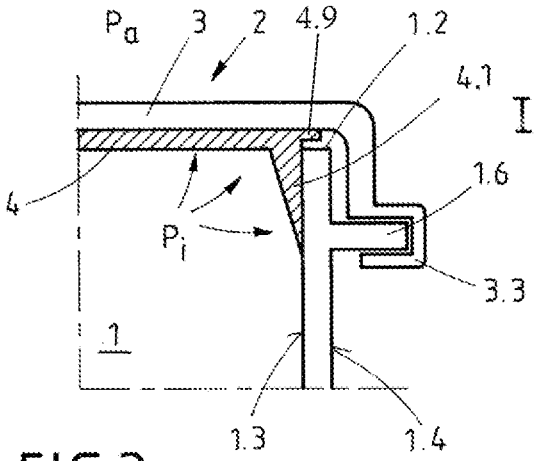
FIG. 3*a* shows a cross-section through a further closure device for a storage container, wherein the closure element comprises a bayonet closure.

FIG. 3*a* shows a further cross-section through another container 1. Here the closure element 3 in configured in the manner of a lid and has a bayonet closure which cooperates positively with the container 1. For this purpose at least one projection 1.6 (usually two projections 1.6) in the form of a pin is provided in the container 1, which cooperates with at least one holding means 3.3 (usually two holding means 3.3) of the closure element 3. The closure element 3 only needs to be placed vertically from above onto the opening 1.1 of the container 1 and turned, for example, by a quarter turn as far as the stop of the bayonet closure. The closure element 2 according to the invention is thus held positively on the container 1. In contrast to FIGS. 1 and 2, the present closure device 2 has no retaining plate 5. Consequently, the sealing element 4 is arranged directly on the inner side of the closure element 3, for example, by a hot embossing method. In FIG. 3*a* the sealing element 4 has an extensive part 4.3 which substantially corresponds to the contour of the opening edge 1.2. An angled edge zone 4.4 which projects annularly downwards is provided on the flat part 4.3 of the sealing element 4. This angled region 4.4 forms the sealing lip 4.1 which in the present case also has a wedge-shaped cross-section. It should be mentioned at this point that rectangular or trapezoidal or differently shaped cross-sections are also feasible for the sealing lip. As a result of the easy elastic deformability of the sealing lip 4.1, this adapts to the inner wall 1.3, wherein the outer edge of the sealing lip 4.1 should be configured to be somewhat larger than the smallest diameter of the contour of the opening edge 1.2. As can be further identified in FIG. 3*a*, the sealing element 4 with a stop means 4.9, which projects radially beyond the sealing lip 4.1 in extension of the extensive part 4.3, also projects into the horizontal gap between the opening edge 1.2 and the closure element 3, but no pressing of the sealing element 4 is made or needs to be made at this point to achieve the desired sealing of the container 1. On the contrary, the stop means 4.9 (see FIGS. 3*a*, 3*b* and 4) serves to position the closure device 2 geometrically exactly on or at the container opening 1.1 so that the sealing element 4 can reliably exert its self-acting sealing mode. In this case, an additional internal pressure Pi also ensures that the sealing lip 4.1 is intensively pressed onto the inner wall 1.3.

Figure 3B:
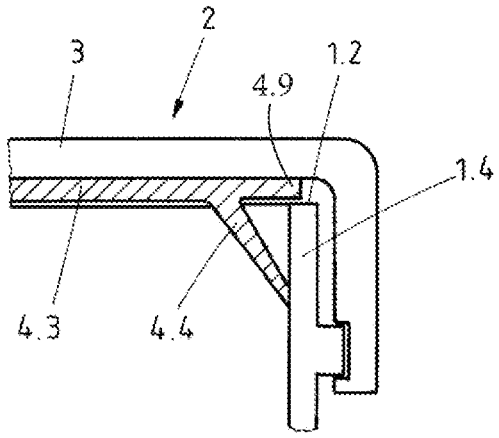
FIG. 3*b* shows a cross-section through a similar closure device from FIG. 3*a*, wherein the sealing element comprises an obliquely disposed sealing lip.

The further FIG. 3*b* shows another variant of the sealing element 4 to FIG. 3*a* in which an extensive part 4.3 is again used, having an obliquely outwardly running sealing lip 4.4 disposed on its outer edge. This sealing lip 4.4 abuts with its free end on the inner wall 1.3 of the opening 1.1 in a punctiform manner, in relation to the cross-section. As a result of the obliquely outwardly (with respect to the inner wall 1.3) directed sealing lip 4.1, geometrical tolerances of the inner contour 1.5 of the opening 1.1 can easily be compensated. With the present sealing element 4, an elevated internal pressure Pi in the container 1 has the result that the sealing lip 4.4 is applied in an arcuate manner and therefore extensively to the inner wall 1.3.

Figure 3C:
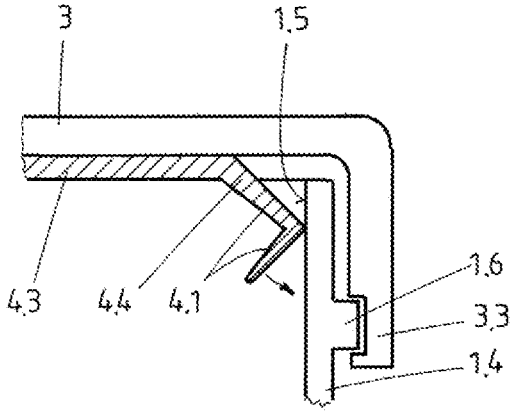
FIG. 3*c* shows a cross-section through a similar closure device from FIG. 3*b*, wherein the sealing element comprises an obliquely disposed, hook-shaped sealing lip.

In the additional FIG. 3*c*, which is comparable to FIGS. 3*a* and *b*, an angled sealing lip 4.4 is also disposed on the outer edge of the extensive part 4.3 of the sealing element 4. In this case, the sealing lip 4.1 itself is configured to be hook-shaped or angled since the free end of the sealing lip 4.1 once again has an angle to the remaining sealing lip 4.1. The lower angled free end of the sealing lip 4.1 serves to simply thread in or cleanly insert the entire sealing lip 4.1 into the opening edge 1.2 when placing the closure device 2 onto the opening 1.1 of the container 1 without changing the basic shape of the seal 4 by bends and corners or the like.

Figure 4:
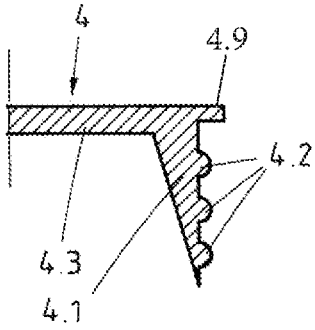
FIG. 4 shows a comparable cross-section through FIG. 3*a* with a sealing lip having protuberances on the edge side.

FIG. 4 shows a further configuration of the sealing element 4 from FIG. 3*a*. In this case circular or bead-like protuberances 4.2 are provided on the wedge-shaped sealing lip 4.1 at the outer edge, whereby the sealing lip 4.1 initially comes to abut against the inner wall 1.3 in a punctiform manner. If the internal pressure Pi increases, the annular protuberances 4.2 are deformed by the elastic deformation of the sealing lip 4.1 in such a manner that overall the sealing lip 4.1 abuts extensively against the inner wall 1.3, as shown in FIG. 3*a*.

Figure 5:
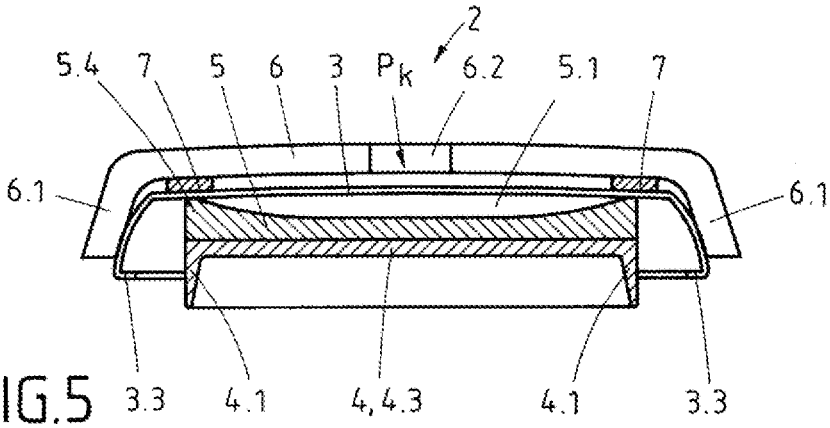
FIG. 5 shows a cross-section through another closure device which is additionally fitted with a safety element and a retaining plate.

FIG. 5 shows a further closure device 2 which has a securing element 6. This securing element 6 serves to improve the handling of the closure device 2 and make it safe. In FIG. 5, the closure element 3 provided again has a click-clack closure. This click-clack closure has the disadvantage that an unintentional pressure (see arrow Pk) on the actuation zone 3.2 in the direction of the container leads to a triggering and therefore springing up or release of the container 1. This can be the case, for example, when a drinks can is placed in a pocket and there comes into contact with other objects in the area of the actuation zone 3.2. In order to avoid this unintentional opening of the closure device 2, the additional securing element 6 is provided. This comprises an inflexible material such as, for example, wood, plastic, metal or the like and above the actuation zone 3.2 has a passage 6.2 for actuating the closure element 3. The securing element 6 is usually connected seamlessly and/or positively to the closure element 3, wherein, for example, on the upper side of the closure element 3, in particular in the edge zone of the centre piece 3.1, it can be connected by fastening means 7. In the present case, the fastening is made by means of a double-sided tape, with a foam layer being provided between the two adhesive layers of the adhesive tape to maintain perpendicular play between the securing element 6 and the closure element 3. Only by means of this perpendicular play is it possible for the securing element also to be used to move the closure device 2 from the second position II into the first position I. In principle, the closure device 2 with the securing element 6 can only be moved from the first position I into the second position II only by a pressure (see arrow Pk) acting in the direction of the container onto the actuation zone 3.2 of the closure element 3. For this purpose, for example, a finger of the user must grip through the passage 6.2 above the actuation zone 3.2 in the securing element 6. Hence the securing element 6 extensively shields the surface of the closure element 3 against an unintentional pressure. If the securing element 6 is also to be used to transfer the present closure element 3 with the click-clack closure from the second position II into the first position I, the angled edge zones 6.1 are required, which correspond with the holding means 3.3 of the closure element 3. An actuating pressure on the securing element 6 exclusively in the direction of the container 1 therefore brings about a simultaneous pressure on the holding means 3.3 of the closure element 3, this pressure being converted into a lateral pressure, with the result that the closure element 3 jumps into its first position I and is held positively by means of the holding means 3.3 and the projection 1.6 on the container 1.

Furthermore, the sealing element 4 in FIG. 5 is connected extensively to the retaining plate 5. The retaining plate 5 ensures that a variable adaptation of the sealing element 4 to the given opening 1.1 of the container can easily be made. In this way, a simple constructive adaptation of the closure device 2 according to the invention to the variously geometrically configured openings 1.1 of the various containers 1 is possible.

It should be mentioned in general at this point that the previously described click-clack closure can be actuated one-handed by a user since the container 1 only needs to be placed on a solid base without being held firmly. By means of the specific pressure in the direction of the container 1, for opening and closing, as described above, the closure device 2 according to the invention with the click-clack closure can be operated simply and conveniently. The additional securing element 6 on the one hand enhances the operating comfort and on the other hand increases the security against unintentional opening of the closure element 3.

Figure 6:
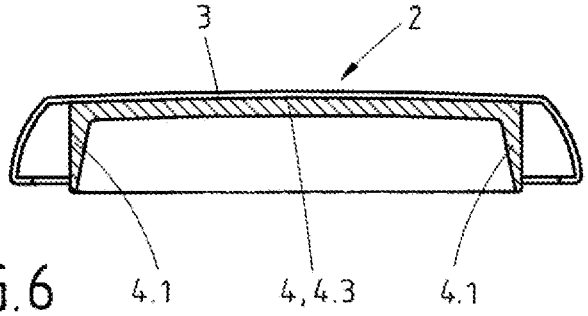
FIG. 6 shows a cross-section through a closure device in which the sealing element is directly connected to the closure element.

FIG. 6 shows a comparable closure device 2 from FIG. 5. However, this closure device 2 has no securing element 6 and no retaining plate 5 on which the sealing element 4 with the closure element 3 is fastened. On the contrary, in FIG. 6 the sealing element 4 is disposed directly on the closure element 3. For this purpose the sealing element 4 is configured to be extensive, the angled edge zones 4.4 being formed by the sealing lip 4.1. Naturally, it is feasible to also fit this variant of the closure device 2 with the securing element 6 and/or the retaining plate 5 described from FIG. 5.

In the closure device 2 according to the invention, the developing internal pressure Pi must fundamentally be intercepted by the closure element 3 since otherwise the sealing element 4 would lift from the opening 1.2 if it were not suitably supported by the inner wall 1.3 or the retaining plate 5 or the closure element 3.

Figure 7A:
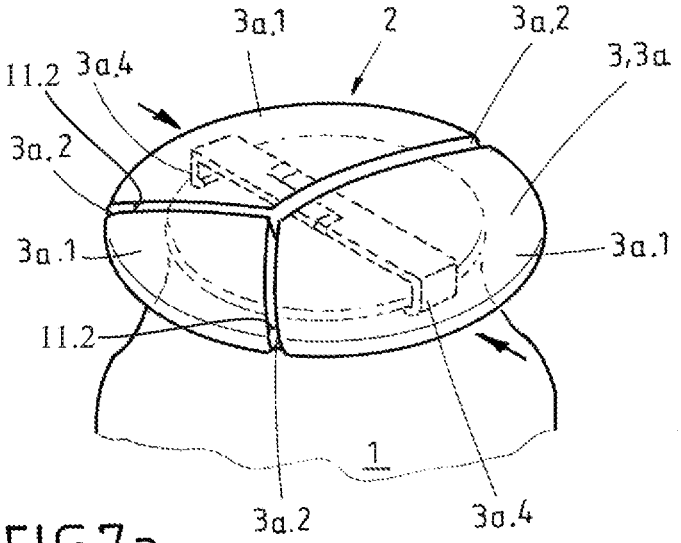
FIG. 7*a* shows a three-dimensional view of a further closure device with a "three-part" closure element.
Figure 7B:
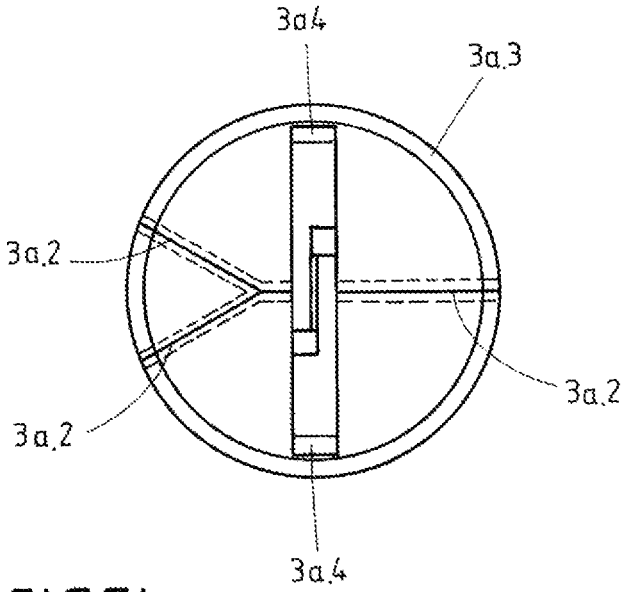
FIG. 7*b* shows a rear view of the closure element from FIG. 7*a*.

In FIGS. 7*a* and 7*b* a further variant of the closure device 2 according to the invention is provided, where a special closure element 3, 3*a* is provided here. In this variant, the entire closure device 2 is constructed in two parts, the closure element 3 forming the first part and the sealing element 4 optionally with the retaining plate 5 forming the second part. It is also feasible to produce the closure device 2 from FIGS. 7*a* and 7*b* in one piece in which case the retaining plate 5 must then be connected to the closure element 3. This can be accomplished, for example, by means of an additional fastening means such as, for example, screws, rivets or the like, or however, the retaining plate 5 is, for example, welded, adhesively bonded to the closure element or injection moulded thereon. In principle, the closure element 3 from FIGS. 7*a* and 7*b* functions as described hereinafter.

The closure element 3, 3*a* is substantially constructed as plate-shaped, comprising three individual pieces 3*a*.1 which are interconnected by means of film hinges 3*a*.2. The three piece 3*a*.1 substantially divide the closure element 3*a* into a "star shape". In order to prevent slipping of the closure element 3*a* from the opening 1.1, the closure element 3*a* has an angled outer edge zone which is configured to be somewhat larger than the contour of the opening edge 1.2. In the first position of the closure element 3*a*, the opening edge 1.2 projects in this angled edge zone 3*a*.3 so that the closure element 3*a* can be displaced to and fro on the opening 1.1 with slight play. The closure element 3 is held positively on the opening edge 1.2 by the two diametrically arranged fastening hooks 3*a*.4 which serve as holding means 3.3. In this case, (see FIG. 7*b*) the upper fastening hook 3*a*.4 is disposed on the lower star piece 3*a*.1 of the closure element 3*a* and the lower fastening hook 3*a*.4 is disposed on the upper star piece 3*a*.1 of the closure element 3*a*. If the upper star piece 3*a*.1 is now pressed onto the lower one, the distance between the two fastening hooks 3*a*.4 increases so that the opening edge of the container 1 is released since the fastening hooks 3*a*.4 no longer grip the projection 1.6 of the container 1 in this intermediate position. As a result, the closure device 2 according to the invention can easily be lifted from the opening 1.1, with one-handed operation also being possible in this case. The closure device 2 according to the invention from FIGS. 7*a* and 7*b* can be fastened by pressing together the two extensive star pieces fastening hooks 3*a*.1 of the closure element 3 (see arrows) so that the distance between the two fastening hooks 3*a*.4 is increased and the closure device 2 can be guided over the opening edge 1.2, in particular the projection 1.6. The closure element 3 can then be released, wherein the film hinges 3*a*.2 provided between the individual star pieces 3*a*.1 press these apart, with the result that the distance between the fastening hooks 3*a*.4 is again reduced so that these grip behind the projection 1.6. By this means the closure element 3*a* overall is fastened positively on the container 1. Since the sealing element 4 with the sealing lip 4.1 is further used, the already-mentioned sealing of the container 1 takes place.

In addition, two or more predetermined breaking points can be provided as a tamper-evident closure in the area of the film hinges 3*a*.2 between the two large star pieces 3*a*.1 and the respective small star piece 3*a*.1, which break when the closure device 2 is actuated for the first time. As a result of a pressure on the two large star pieces 3*a*.1, the small star piece 3*a*.1 is pressed out from the existing angle, in which case it can result in the desired breaking of the predetermined breaking points.

Figure 8A:
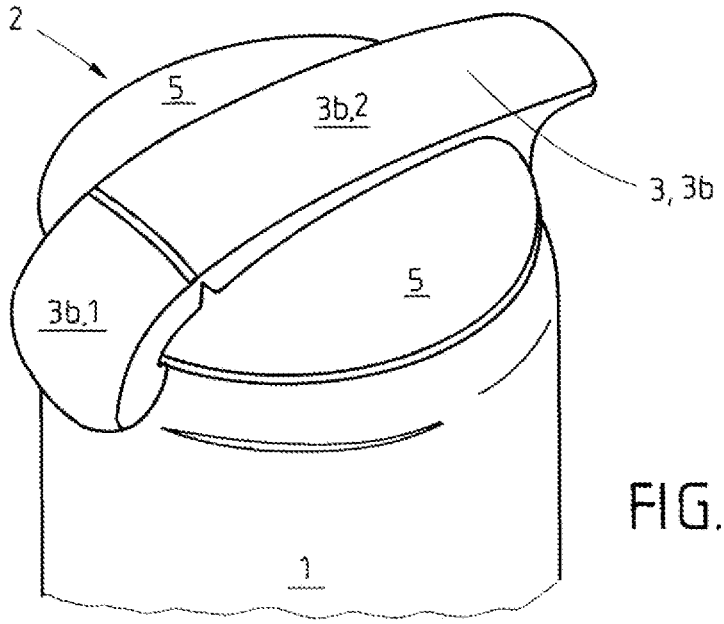
FIG. 8*a* shows a three-dimensional view of an additional closure device which has a clip-shaped closure element.
Figure 8B:
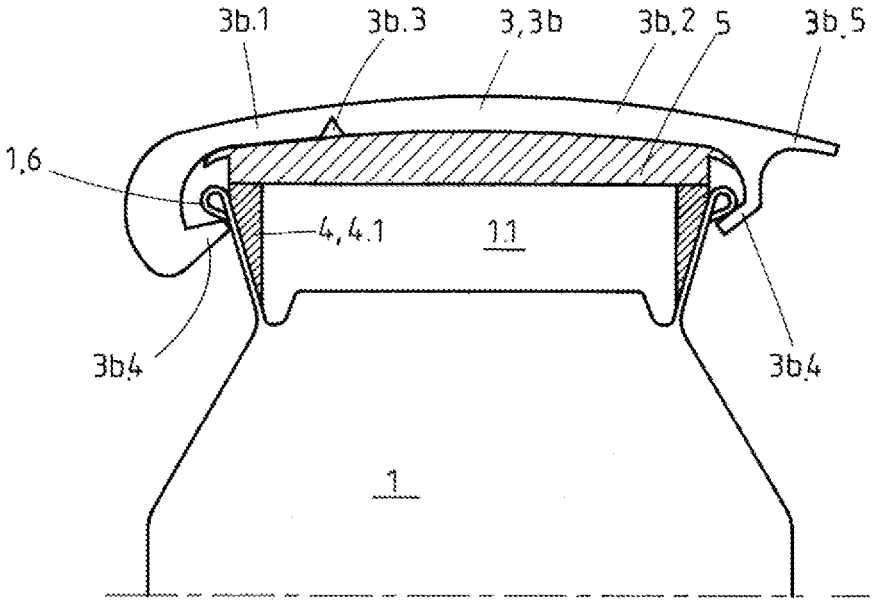
FIG. 8*b* shows a cross-section through the closure device from FIG. 8*a*.

A further closure device 2 according to the invention is provided in FIGS. 8*a* and 8*b*, where a clip-like closure element 3, 3*b* is used. FIG. 8*a* shows the closure device 2 according to the invention in three-dimensional view. The operating mode of the closure element 3, 3*b* according to the invention is obtained from the sectional drawing in FIG. 8*b*. It can be identified there that the entire closure device 2 comprises a closure element 3*b*, a sealing element 4 and a retaining plate 5. In the present variant the retaining plate 5 with the sealing element 4 fastened thereon, which is merely configured as sealing lip 4.1, is held by the clip-shaped closure element 3 on the container 1. For this purpose the retaining element 5 can be fastened with the closure element 3*b*. In order to achieve mobility of the closure element 3*b*, an incision 3*b*.3 is provided between the first region 3*b*.1 and the second region 3*b*.2 of the closure element 3. Expediently the retaining plate 5 with the sealing element 3 is arranged on only one region 3*b*.1 or 3*b*.2 of the closure element 3*b*, preferably with the region 3*b*.2. The present closure element 3 can be operated easily and with one hand. In this case, the first fastening hook 3*b*.4 grips against a projection 1.6 on the opening edge 1.2 of the container 1 and then the second fastening hook 3*b*.4 is raised behind the projection 1.6 which this grips positively. For this purpose the clip-shaped closure element 3*b* can allow a certain elastic deformation which is increased by the incision 3*b*.3. However, it is also feasible that the clip-shaped closure element 3*b* is configured substantially rigidly, where, for example, wood, metal or stable plastic can be provided. The closure device 2 is removed in the reverse order, by raising the right actuating tab 3*b*.5 from below, whereby the right fastening hook 3*b*.4 is released from the projection 1.6 and the entire closure device 2 can be removed. In FIG. 8*b* it is clear that the retaining plate 5 must in no way come in contact with the container 1. On the contrary it is sufficient if the sealing element 4, in particular the sealing lip 4.1, is in contact with the inner wall 1.3. As a result of the internal pressure Pi which may build up, the entire closure device 2 is automatically pressed vertically upwards, i.e. away from the container 1 so that the closure device 2 is fastened to the container 1 free from play.

FIGS. 9*a* to 10*b* show two further variants of the closure device 2 according to the invention, wherein a closure element 3, 3*c* with bracket-like actuating elements 3*c*.1 is used here. In FIGS. 9*a* and 9*b* the two actuating elements 3*c*.1 of the bracket-like closure element 3, 3*c* are directed upwards. These two actuating elements 3*c*.1 only need to be pressed towards one another (see arrows) so that the holding means 3.3 configured as hook-shaped projections 3*c*.2 spread apart and release the projection 1.6 on the opening edge 1.2. A retaining plate 5 which has the sealing element 4 towards the bottom can be disposed positively on the underside of a horizontal strut 3*c*.3. The horizontal strut 3*c*.3 connects the two bracket-like actuating elements 3*c*.1 and can be formed of the same material as these and in one piece. In FIGS. 9*b* and 10*b*, the respective bracket-like closure element 3, 3*c* is shown alone, i.e. without the retaining plate 5 and the sealing element 4 which are merely indicated by dashed lines. In this case, the bracket-like closure element 3, 3*c* is located in the second position II in which this does not close the container 1.

A paper or film seal can, for example in FIG. 9*a*, be glued onto the container neck 1 as a tamper-evident closure of one or both bracket-like closure elements 3*c*. This paper seal would automatically tear upon a first actuation of the closure device 2.

In FIGS. 10*a* and 10*b* the two actuating elements 3*c*.1 are located at the bottom, i.e. towards the container 1. These must also be compressed in the direction of the two arrows so that the two hook-shaped projections 3*c*.2 again release the opening edge 1.2 so that the closure device 2 according to the invention can be raised from the container 1. This closure element 3, 3*c* again has a horizontal web 3*c*.3 or strut 3*c*.3 which interconnects the two actuating elements 3*c*.1 and on which the retaining plate 5 with the sealing element 4 is arranged. FIG. 10*b* shows an exemplary view of the closure element 3 from FIG. 10*a*. For better handling, protuberances or holes 3*c*.4 are provided in the two actuating levers so that the fingers of the user find a better hold and do not slip.

Figure 11A:
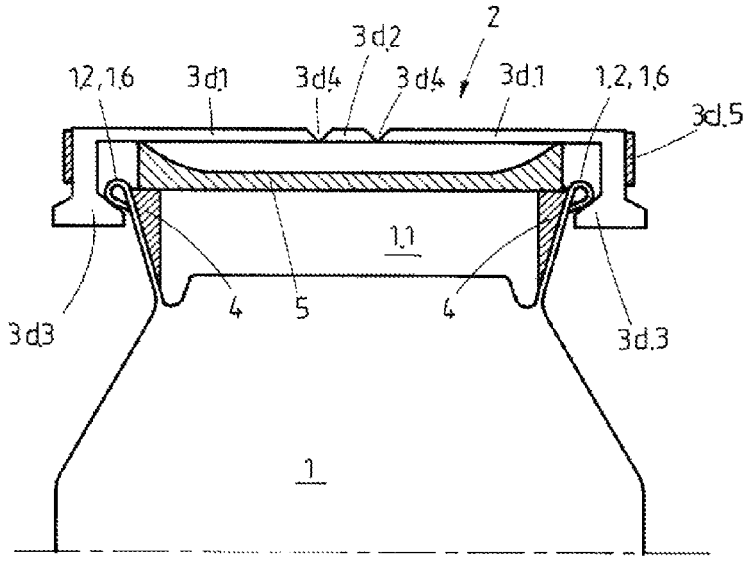
FIG. 11*a* shows a cross-section through a further closure device on a container having a plate-shaped closure element.
Figure 11B:
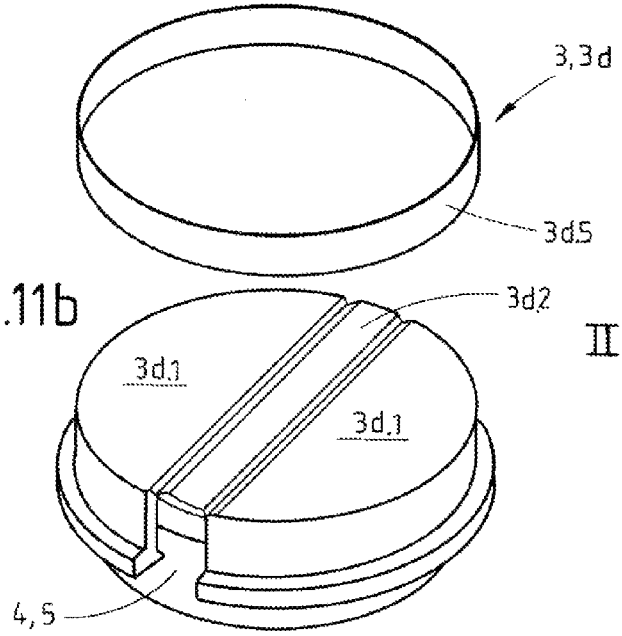
FIG. 11*b* shows a closure device from FIG. 11*a* in the dismounted state.

The further FIGS. 11*a* and 11*b* show an additional variant of the closure device 2, this functioning substantially as the clip-like closure device 3, 3*b* from FIGS. 8*a* and 8*b*, where the closure element 3, 3*d* is configured as plate-shaped and has a projection 3*d*.3 as holding means 3.3 at the bottom, which cooperates positively with the projection 1.6 of the opening edge 1.2 of the container 1. In order to be able to invert the two circular segments 3*d*.1 on which the holding means 3.3 of the closure element 3 are disposed, over the projection 1.6 of the container 1, a partially interrupted connecting web 3*d*.2 is provided centrally, wherein the two circular segments 3*d*.1 are fastened by means of film hinges 3*d*.4. By this means a tilting movement of the entire closure element 3*d* can easily be achieved. However, in order to be able to close the container 1 securely, a retaining or clamping ring 3*d*.5, e.g. in the form of a plastic strip, steel strip (both not expansible) or also rubber rings can additionally be used, this ring being clamped over the external circumference of the closure element 3, whereby the projections 3*d*.3 of the closure element 3 grip securely behind the projection 1.6 of the container 1 and remain in place. In order to release this closure device 2, the retaining or clamping ring 3*d*.5 must firstly be removed so that the closure element 3 can then be easily tilted from the container 1. FIG. 11*b* shows a three-dimensional view of the closure device 2 with the plate-shaped closure element 3, 3*d*.

It should also be mentioned that there are numerous further variants for the closure element 3. Also it is not necessary for the opening 1.1 of the container 1 to be circular, rather this can also be configured to be elliptical, rectangular or differently shaped without the mode of operation of the closure device 2 according to the invention being thereby influenced. On the contrary, the closure element 3 and the sealing element 4 must be adapted to the contour of the opening 1.1.

Figure 12:
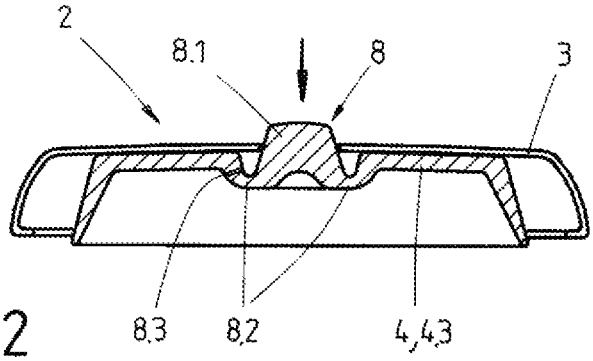
FIG. 12 shows a cross-section through a closure device with a valve, in particular a slit valve.
Figure 13A:
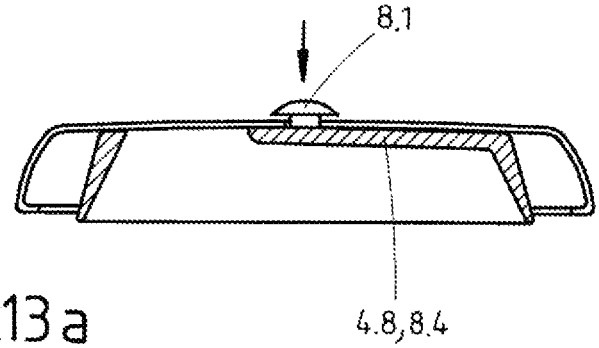
FIG. 13*a* shows a cross-section through a further closure device with a different valve.

FIGS. 12 and 13*a* show a closure device 2 having a valve 8. In this case, the valve 8 is substantially formed by the sealing element 4 and the closure element 3 or the retaining plate 5.

Figure 13B:
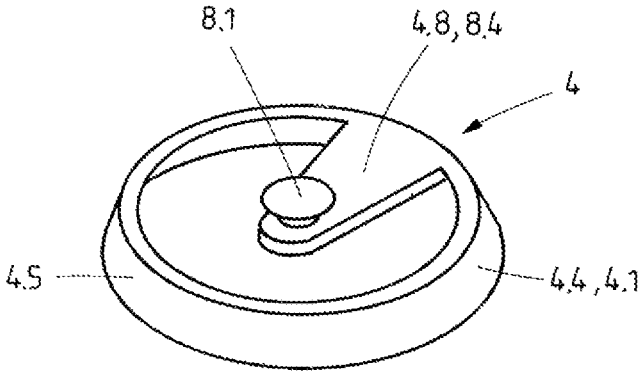
FIG. 13*b* shows a three-dimensional view of the sealing element of the closure device from FIG. 13*a*.

As can be identified in FIG. 12, an extensive sealing element 4 is used, wherein an actuating nipple 8.1 is provided in the flat part 4.3, which nipple forms a part of the valve 8. Provided at the corrugated end 8.2 of the actuating nipple 8.1 is a small, almost horizontal incision 8.3 in the sealing element 4 which can be expanded by an external perpendicular pressure on the actuating nipple 8.1 in the direction of the container 1, whereby the internal pressure Pi can escape from the container 1. As a result of the geometry of the incision 8.3, the two incision walls are normally pressed against one another so a seal is hereby made. The higher the internal pressure Pi here, the more firmly the two incision walls are pressed onto one another with the result that the sealing effect in the valve region is increased. In the example from FIG. 12, the sealing element 4 is attached directly to the underside of the closure element 3. The retaining plate 5 can also be used in this variant, in which case a corresponding passage must then also be provided in the retaining plate 5 for the actuating nipple 8.1 of the valve 8. The closure element 3 itself comprises a click-clack closure which has been sufficiently described previously. In this design (see FIGS. 12, 13*a*, 13*b*) of the closure device 2, an actuation of the valve 8 initially takes place automatically followed by an opening of the closure element 3 by a single perpendicular pressure (see arrow) on the actuating nipple 8.1 and the central actuation zone 3.2.

Furthermore, a blow-in or cutting edge for producing an acoustic sound can be provided, for example, in the incision 8.3, the sound being produced by the escaping fluid at excess pressure Pi, which is usually gaseous. It is also feasible to provide the release or cutting edge elsewhere in the area of the valve outlet, for example, in the region of the passage 6.2.

In FIG. 13*a* another variant is used for a valve 8 in the closure device 2 according to the invention. In this case, the actuating nipple 8.1 is disposed on a projecting tongue 4.8 of the sealing element 4 in order to press this from the inner side of the closure element 3. The projecting tongue 4.8 of the sealing element 4 forms a membrane 8.4 for the valve 8. The complete sealing element 4 is shown alone in three-dimensional view in FIG. 13*b*. As a result of the shape of the sealing element 4, the projecting tongue 4.8 of the sealing element 4 abuts against the inner side of the closure element 3, whereby the tongue 4.8 can be fixed extensively on the underside of the closure element 3. The sealing element 4 should only not be connected to the closure element 3 directly below the actuating nipple 8.1 so that under a pressure on the actuating nipple 8.1, this has the possibility to form a small gap through which the elevated internal pressure Pi can be reduced. A developing internal pressure Pi in this case also increases the contact pressure of the tongue 4.8 on the underside of the closure element 3, thereby increasing the sealing effect of the valve 8. In addition, the actuating nipple 8.1 can be loaded by a compression spring so that the sealing tongue 4.8 or 8.4 can thus be pressed by the spring force onto the inner side of the closure element 3. If a pressure is now applied to the actuating nipple 8.1 in the direction of the arrow shown, the sealing tongue 4.8 will be released from the inner side, whereby the internal pressure Pi can escape to the surroundings. In the present example, the retaining plate 5 can also be provided between the closure element 3 and the sealing element 4. In addition, it should be mentioned that the previously described valves 8 can also be combined with all variants and exemplary embodiments of the closure element 3. Likewise, the safety element 6 already described can be used in the aforementioned exemplary embodiments of the invention with the valve 8.

Figure 14:
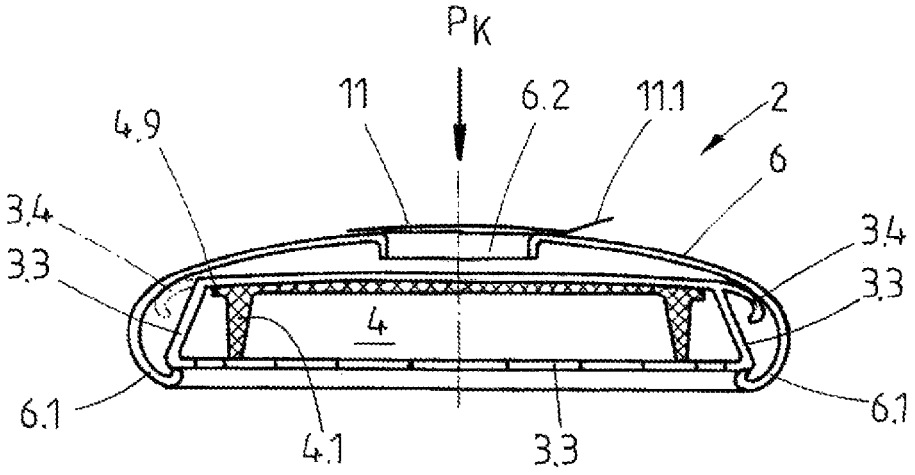
FIG. 14 shows a cross-section through a closure device in which the sealing element is completely integrated in the closure element and FIG. 15 shows an inner view of a closure device in which the sealing element is positively fastened on the closure element.

FIG. 14 shows a similar closure device 2 to that from FIG. 5 or 6 in cross-section. Unlike the exemplary embodiments from FIG. 5 or 6, the sealing element 4 does not project from the lower opening of the closure element 3 so that it can also be safely said that the sealing element is disposed or integrated completely in the closure element 3 or the closure device 2. This integration now has the advantage that the sealing element 4 does not touch a table or other placement surface when the closure device 2 is removed from the container 1 and placed on the placement surface, regardless of on which side. Consequently, an unintentional wear of the sealing element 4, in particular of the sealing lip 4.1, can be reliably avoided. In addition, the integrated sealing element 4 can ensure that the sealing lip 4.1 is not crimped or crumpled when the closure device 2 is placed on the opening edge 1.2 of the container. On the contrary, the external holding means 3.3 now provides for a first positioning of the closure device on the opening edge 1.2. A secure handling is thus ensured by the integrated sealing element 4.

Furthermore, FIG. 14 shows a tamper-evident closure 11 which comprises a paper seal or a film seal. The opening of the passage 6.2 in the securing element 6 is completely sealed by this tamper-evident closure 11. If the container is merely to be opened by the closure device 2, the tamper-evident closure 11 must be destroyed or removed so that a pressure Pk can be applied through the passage 6.2 onto the closure element 3, in particular the centre piece 3.1. A pull tab 11.1 can additionally be provided so that the tamper-evident closure 11 can easily be removed. It is also feasible to provide the tamper-evident closure 11 with predetermined breaking points 11.2 in order to be able to ensure an immediate destruction on opening.

In FIG. 14 holding elements 3.3 of the closure element 3 are bent outwards and thus configured as closing means 3.4 of which one is visible and one is indicated in FIG. 14. preferably at least three holding means 3.3 are configured as closing means 3.4 which can be at an angle of 120° between each another. The securing element 6 abuts with its edge zone 6.1 from outside against the closing means 3.4, the closing means 3.4 being configured as a rounding of the edge zone 6.1. If a user exerts a perpendicular pressure (parallel to the arrow Pk) on the upper region of the securing element 6, the edge zone 6.1 only acts on the closing means 3.4, whereby the closure element 3 is sealed (position I of the closure device 2). At the same time, the closing means 3.4 can be used to connect the closure element 3 to the securing element 6 securely and positively. Consequently, the lower flanged edge of the edge zone 6.1 could also end at the height of the closing means 3.4 or at least cooperate mechanically with this. In the case of FIG. 14, the lower flanged edge of the edge zone 6.1 serves as a terminating or placement surface or edge of the closure device 2.

Figure 15:
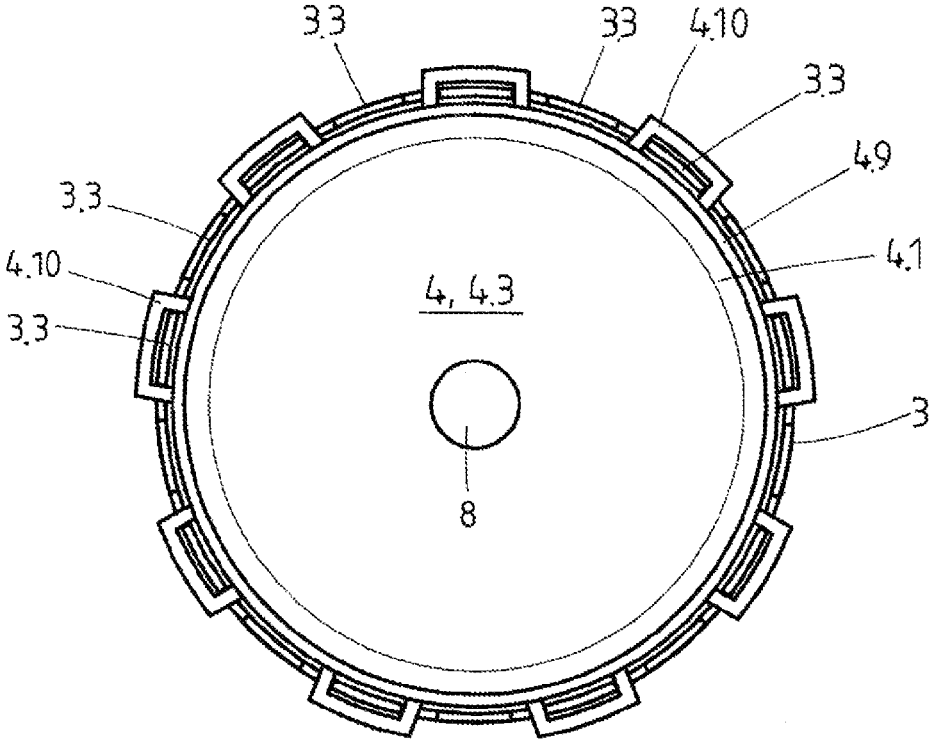

The further FIG. 15 shows a positive fastening of the sealing element 4 on the closure element 3. In this variant, on its outer star-shaped edge 4.10, where the star points themselves are flattened in an arcuate manner, the sealing element 4 has slit-shaped passages for the arcuate holding means 3.3 of the closure element 3. For example, the sealing element 4 can have the slit-shaped passages for every other holding means 3.3, as shown. It is also feasible that a slit-shaped passage is provided for each holding means 3.3 so that the sealing element 4 can be entirely bordered by the corresponding slit-shaped passages over its full circumference, i.e. in a disk shape. Instead of the positive fastening of the sealing element 4 by means of the holding means 3.3, it can be provided that the sealing element 4 is fastened to the closure element 3 by a hot embossing process or a welding process. Naturally, the retaining plate 5 can also be used for this.

It is furthermore feasible that the individual technical features from the variants of the closure device 2 according to the invention can be combined with one another, provided that these are not technically mutually exclusive.

The invention claimed is:

1. A closure device for closing an opening of a container, wherein the opening of the container has an opening edge, which comprises an inner wall and an outer wall, and wherein the closure device has a sealing element whereby the opening of the container can be closed in a sealing manner, wherein a sealing of the container by the closure device is independent of a contact pressure which is applied from the closure device onto the container, wherein the sealing element has a sealing lip projecting into the opening of the container and comes to abut sealingly against the inner wall of the opening edge due to an elastic deformation, wherein the sealing element simultaneously forms a valve element so that the internal pressure of the container is automatically adjusted to the external pressure of the container if the external pressure is greater than the internal pressure.

2. The closure device according to claim 1, wherein the seal is made by the shape and size and the material properties of the sealing element.

3. The closure device according to claim 1, wherein the contact pressure which is applied from the closure device onto the container is substantially without effect on the sealing element.

4. The closure device according to claim 1, wherein the container can be sealed by the closure device by means of the sealing element in a pressure-tight and/or fluid-tight manner, wherein the closure device can be reused.

5. The closure device according to claim 1, wherein an outer contour of the sealing element is configured to be complementary to an inner contour of the opening edge of the container, wherein the sealing element abuts against the inner wall of the opening edge over the full circumference.

6. The closure device according to claim 1, wherein the sealing lip of the sealing element is only pressed onto the inner wall by its elastic deformation, wherein an internal pressure of the container additionally presses the sealing lip onto the inner wall if the internal pressure is greater than an external pressure surrounding the container from outside.

7. The closure device according to claim 1, wherein the sealing element flatly seals the entire opening of the container with a flat part, wherein the sealing element has an angled edge zone which is disposed on the flat part on the edge side and is substantially formed by the sealing lip.

8. The closure device according to claim 1, wherein the closure device has a retaining plate to which the sealing element is fastened, wherein the sealing element is only configured as a sealing lip and the sealing lip is arranged in a pressure-tight and/or fluid-tight manner on the retaining plate.

9. The closure device according to claim 1, wherein the closure device is fastened on the container by a closure element, wherein the closure element cooperates positively with the container by means of a closure comprising a threaded closure, a bayonet closure, a click-clack closure, a clasp closure, a clip closure, a loop closure and/or a sliding closure.

10. The closure device according to claim 1, wherein the closure device is fitted with a safety element and/or a valve, wherein the safety element avoids an unintentional opening of the container and the valve is configured as a pressure relief valve or a drain valve.

11. A container for fluids, having a closure device according to claim 1.

12. A method for sealing a container having an opening by a closure device, wherein the opening of the container has an opening edge, which comprises an inner wall and an outer wall, and wherein the closure device has a sealing element whereby the opening of the container can be closed in a sealing manner, wherein a sealing of the container by the closure device takes place independently of a contact pressure which is applied from the closure device onto the container, wherein the sealing element has a sealing lip projecting into the opening of the container and comes to abut sealingly against the inner wall of the opening edge due to an elastic deformation, wherein the sealing element simultaneously forms a valve element so that the internal pressure of the container is automatically adjusted to the external pressure of the container if the external pressure is greater than the internal pressure.

13. The method for sealing a container according to claim 12, wherein the sealing element has a sealing lip which projects into the opening of the container and comes to abut sealingly on the inner wall of the opening edge due to an elastic deformation and wherein in a first position the closure device closes the opening of the container and in a second position releases the opening, wherein the change of the positions is made by a one-handed actuation, wherein a click-clack closure, a clasp closure, a clip closure, a loop closure and/or a sliding closure are used.

* * * * *